United States Patent [19]

Mitter

[11] 4,074,625

[45] Feb. 21, 1978

[54] SCREEN PRINTING MACHINE

[76] Inventor: Mathias Mitter, Falkenstrasse 57, 4815 Schloss Holte, Germany

[21] Appl. No.: 726,875

[22] Filed: Sept. 27, 1976

[30] Foreign Application Priority Data

Sept. 29, 1975 Germany ..... 2543423

[51] Int. Cl.[2] ..... B41F 15/38; B41F 15/10

[52] U.S. Cl. ..... 101/128.1; 68/200; 101/115; 101/172; 118/242

[58] Field of Search ..... 101/114, 115, 116, 119, 101/120, 127.1, 128.1, 129, 122, 172, 211; 118/213, 240, 242; 68/200

[56] References Cited

U.S. PATENT DOCUMENTS

| | | | |
|---|---|---|---|
| 3,056,384 | 10/1962 | Beale et al. | 101/115 X |
| 3,294,018 | 12/1966 | Heonis | 101/119 X |
| 3,530,693 | 9/1970 | Dimond et al. | 101/172 X |
| 3,879,966 | 4/1975 | Worth et al. | 101/172 X |
| 3,892,176 | 7/1975 | Van der Winden | 101/116 |
| 3,892,177 | 7/1975 | Giani | 101/127.1 X |

FOREIGN PATENT DOCUMENTS

| | | | |
|---|---|---|---|
| 46-28715 | 8/1971 | Japan | 101/172 |
| 47-38037 | 9/1972 | Japan | 101/172 |
| 47-8197 | 3/1972 | Japan | 101/172 |

*Primary Examiner*—R.E. Suter

*Attorney, Agent, or Firm*—Michael J. Striker

[57] ABSTRACT

An endless printing screen of generally annular configuration is supported in end bearings. An arrangement of tubes admits printing medium into the interior of the screen so that it can pass through the latter to print onto a web beneath the screen. A device is provided for reciprocating the endless screen.

15 Claims, 10 Drawing Figures

Fig.7
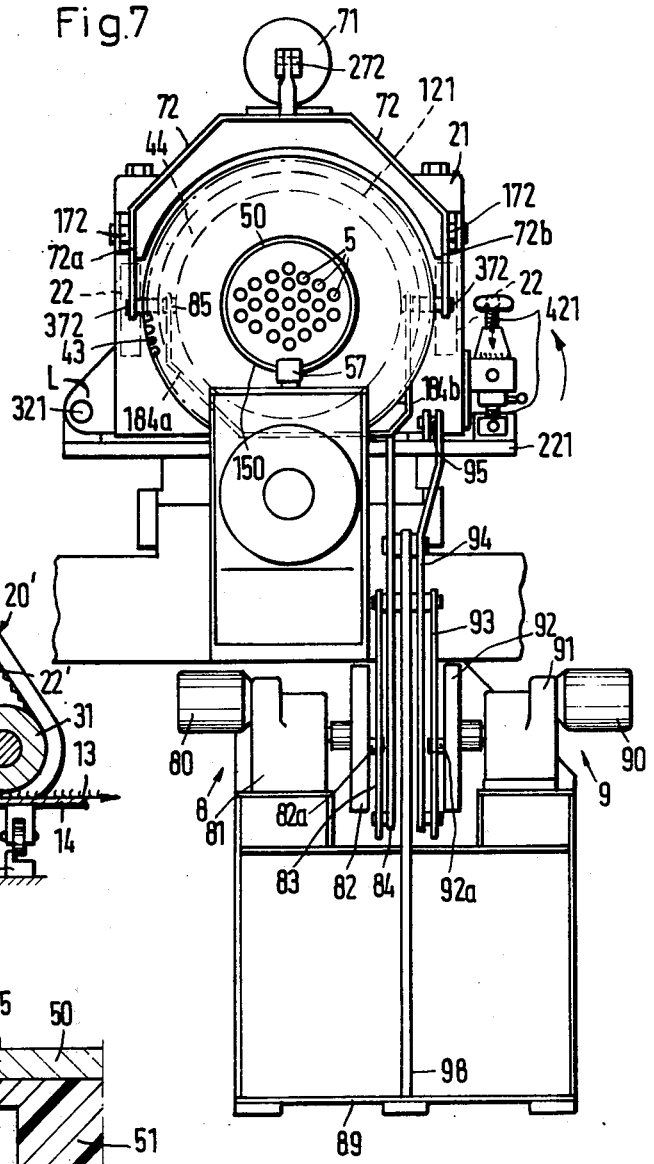
Fig.8
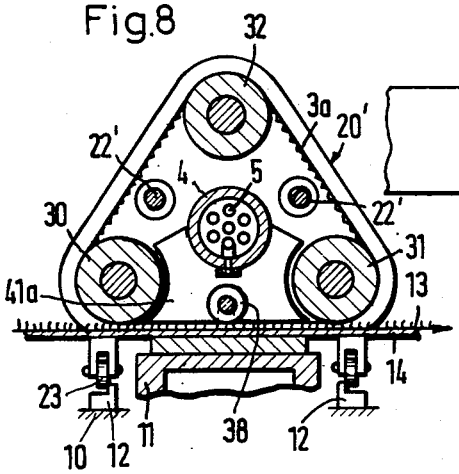
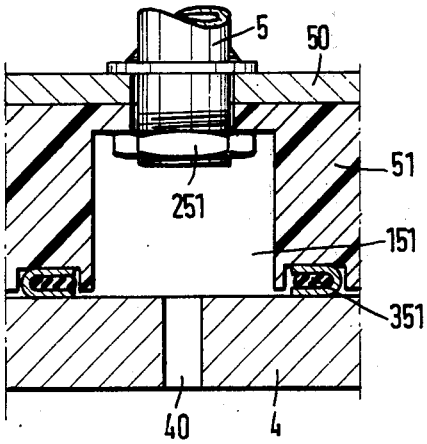
Fig.6

SCREEN PRINTING MACHINE

BACKGROUND OF THE INVENTION

The present invention relates to a screen printing machine in general, and more particularly to a screen printing machine of the type utilizing an endless travelling printing screen.

Screen printing machines are either of the type having a flat or planar printing screen, or of the type having an endless travelling printing screen. The latter type comes in two basic varieties, one wherein the printing screen is tubular and the other wherein the printing screen is an endless belt which is trained about a plurality of rollers, usually three rollers which are arranged at the corners of a triangle. In either case, the printing screen is of generally annular configuration.

Screen printing machines of the type having an endless travelling printing screen may be provided with one or more printing stations at each of which one of these printing screens is provided. If two or more such stations are utilized, the machine is suitable for multi-color printing. The workpiece web, such as a textile web, a carpet web or the like, is supplied beneath the printing screen, in some instances on a printing blanket which travels beneath the printing screen relative to the same and supports the web. At each printing station a printing medium, for example printing ink, ink paste or the like, is admitted into the interior of the space surrounded by the endless printing screen and is then usually squeezed by means of a squeegee or the like, through the perforations of the printing screen and onto the underlying workpiece web. The perforations of the screen which have been left permeable to the printing medium — other perforations having been made impermeable — produce the desired printing pattern.

The disadvantage of the prior-art printing machines is that the pattern is repeated again and again on the workpiece, i.e. the pattern is repeated in a constantly reoccurring uniform sequence.

SUMMARY OF THE INVENTION

It is an object of the present invention to provide an improved screen printing machine which avoids this disadvantage.

More particularly, it is an object of the invention to provide such a screen printing machine which makes it possible to vary the patterning, i.e. the application of the pattern to a workpiece web, within a very substantial range of possibilities.

In keeping with these objects, and with others which will become apparent hereafter, one feature of the invention resides in a screen printing machine which, briefly stated, comprises an endless printing screen of generally annular configuration, end bearing units located at the respective ends of the annulus formed by the endless printing screen and mounting the latter for advancement in an endless path, and admitting means for admitting printing medium into the interior of the generally annular endless printing screen for subsequent passage of the printing medium through the printing screen and printing on a web beneath the screen. Further, the improved screen printing machine comprises reciprocating means for reciprocating at least one of the screen and admitting means in direction axially of the annulus formed by the endless printing screen.

The novel machine according to the present invention makes it possible, for the very first time, to make the printing screen wider than the web to be printed and to reciprocate the screen transversely of the path of advancement of the web through greater or lesser distances — which may also be continuously varied, if desired — so as to constantly offset the pattern being printed with respect to the pattern which has just been printed immediately downstream or the pattern which will be printed immediately upstream. If two or more printing stations are used, the reciprocation of all stations may be identical, or else the screens at successive stations may reciprocate in mutually opposite directions during each stroke or the reciprocation of successive printing stations may vary completely, in order to produce any type of desired pattern.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 6 is an enlarged-scale fragmentary sectional detail view;

FIG. 7 is a view of the machine in FIG. 1, seen in the direction of the arrow VII of FIG. 1;

FIG. 8 is a somewhat diagrammatic fragmentary cross-section through a printing station of a different type of screen printing machine.

DESCRIPTION OF THE PREFERRED EMBODIMENTS

Figure 1:
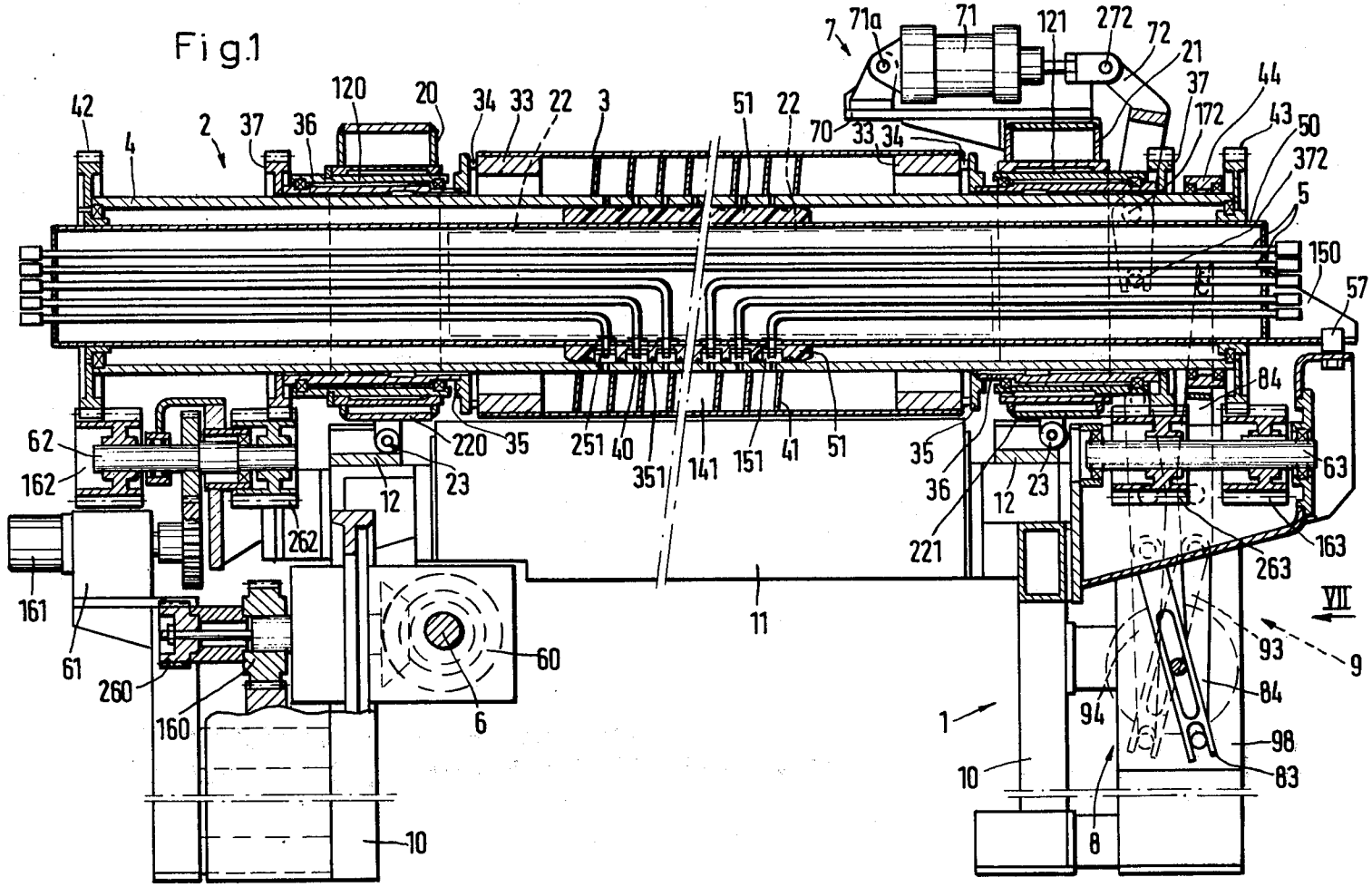
FIG. 1 is a fragmentary vertical section through a printing station of a screen printing machine embodying the invention.

Before discussing the individual embodiments in detail it should be understood that with the exception of specifically stated items, the embodiments disclosed herein utilize the same basic elements which will, therefore, be identified throughout the drawing with identical reference numerals.

Referring firstly to the embodiment in FIGS. 1, 2 and 4–7, it will be seen that the screen printing machine according to the present invention as illustrated in these embodiments has a frame 1 which is provided in the area of each printing station (only one shown) with a printing-medium applying device 2. In the region of each printing station the frame 1 is provided with upright supports 10 which are connected with one another by counter pressure beams 11. A printing blanket (not shown) may pass over the counter pressure beam 11 on top thereof, and may carry on its upper surface the workpiece web to be printed. It is emphasized that the printing blanket and workpiece web are shown only in the embodiment of FIG. 8 where they are identified with reference numerals 14 and 13, respectively. However, their presence is equally applicable to all of the other embodiments.

Mounted above the counter pressure beam 11 at the respective printing station is a printing screen 3 which in this first embodiment is of the tubular type, i.e. it is endless and of tubular shape. Mounted on the upright supports 10 are two end bearing units 20 and 21, respectively. The unit 20 is associated with the left-hand end of the tubular printing screen 3 and the unit 21 with the right-hand end thereof. The units 20 and 21 serve to mount the printing screen 3 for rotation about a generally horizontal axis. For this purpose the opposite axial ends of the tubular printing screen 3 have set into them and secured to them respective end rings 33 which are connected via connecting pins 34 with annular support plates 35 which in turn are rigidly connected with bearing sleeves 36. These are rotatably received in journalling sleeves 120 and 121, of which the sleeve 120 is mounted in the end bearing unit 20 and the sleeve 121 is mounted in the end bearing unit 21. The axially outer ends of the sleeves 36 are provided with gears 37 by means of which the printing screen 3 is to be driven in rotation, as will be discussed subsequently. The screen 3 is driven at both of its axial ends in the illustrated embodiment; however it should be understood that if it is desired — for example if the screen 3 is sufficiently strongly tensioned in axial direction thereof so as to be able to withstand the twisting forces resulting from the application of driving torque at only one end — it can be driven at only one of its axial ends.

The embodiment of FIGS. 1, 2 and 5–7 shows a drive for rotating the printing screen 3. This drive comprises a main machine drive shaft 6 which may extend the length of a machine having a plurality of printing stations, and which is associated at each printing station (illustrated by way of example for the one shown in FIG. 1) with an angle drive 60. The main drive shaft 6 is rotated in any conventional manner by an appropriate prime mover and transmits rotation to the angle drive 60 which in turn rotates gears 160 and 260. The gear 260 transmits motion to a variable drive unit 61, for example to an adjustable differential drive having a control motor 161. Such drives are well known per se, and are sold by "PIV" Werner Reimers KG, Bad Homburg.

The drive unit 61 in turn rotates a gear train 62 having gears 162 and 262; the gear 262 meshes with the gear 37 at the left-hand end of the printing station so as to drive the left-hand end of the printing screen 3. The gear 162 meshes with a gear 42 which is mounted on the left-hand end of a tubular carrier 4 but extends through the end bearing units 20, 21 and through the screen 3, defining an annular clearance with the latter. The carrier 4, which will be described subsequently in more detail, serves the purpose — insofar as motion transmission is concerned — of transmitting motion to the right-hand end of the printing screen 3 so as to drive the screen at the right-hand end also, in addition to the drive applied to it at the left-hand end. For this purpose the right-hand end of the carrier 4 is provided with a gear 43 which meshes with a gear train 63 having gears 163 and 263 which are mounted on a common shaft. Gear 263 rotates the gear 37 at the right-hand end of the tubular printing screen 3 so that when the gear 263 is driven in rotation by transmission of motion from gear 43 to gear 163, it in turn rotates the gear 37 and thus transmits motion to the right-hand end of the printing screen 3.

The application of torque to both axial ends of the printing screen 3 is advisable, but must be as identical as possible at both ends, since the printing screen 3 is essentially a rather delicate structure composed of extremely thin stainless steel foil or the like, and would become damaged if differential torque were to be applied to its opposite axial ends. The speed of rotation of the screen 3 may, incidentally, be varied by replacing appropriate gears so as to change the gear ratios.

The end bearing units 20 and 21 are connected with one another by traverse members 22 of which two or more are provided, so as to form a rigid unit. The end bearing units 20 and 21 have base plates 220 and 221, respectively, which are provided with rollers, wheels, glides or the like 23 that engage in and move along rail sections 12 provided on the uprights 10. Thus, the rigid unit composed of the end bearing units 20, 21 and the traverse members 22 can reciprocate in the axial direction of the screen 3, i.e. transversely of the path of movement of the workpiece web to be printed, which path of movement is normal to the plane of FIG. 1. It will be noted that the axial length of the gears 162, 163, 262 and 263 is substantially greater than the axial length of the gears 42, 43, 37 with which they mesh; this is to assure that despite axial reciprocation of the aforementioned unit, these gears will remain in mesh throughout. It should be noted, however, that the device for supplying and applying printing medium need not be constructed in the manner illustrated and to be described subsequently, which manner is the reason for making the gears 162 and 163 of a greater axial length than their meshing gears; it would be possible to construct the printing medium applicating device as a simple squeegee roller or the like, or a doctor-blade type of squeegee, and this would not detract from the advantages obtained by axially reciprocating the screen 3.

However, the particular construction illustrated in FIGS. 1, 2 and 5-7 has particular advantages in conjunction with the axial reciprocation of the screen 3. The construction of the printing medium applicating device 2 in the illustrated embodiment is such that in the interior of the hollow carrier 4 which is driven in rotation, there is located an inner tube 50 which extends through the carrier 4 and defines with the same an annular space. The carrier 4 carries a plurality of partitions 41 which extend across the clearance defined between the carrier 4 and the interior surface of the printing screen 3 and form in this clearance at least two — as illustrated, however, a plurality — of printing medium chambers 141 into which printing medium is admitted. A plurality of printing medium tubes 5 extends into the interior of the inner tube 50 through the opposite axial ends thereof and the free ends of these tubes 5 extend through the wall of the inner tube 50 and into chambers 151 which are formed in the circumferential wall of a spacing sleeve 51 which is preferably of synthetic plastic material — e.g. *pvc*, polyethylene or the like — with each of which one of the tubes 5 communicates and wherein the free end of the respective tube is secured by means of a nut 251. Each of the compartments or chambers 151 in turn communicates with an opening 40 formed in the circumferential wall of the tubular carrier 4 which opening in turn communicates with a respective one of the chambers 141. Different-colored printing media may be applied into each of the chambers 141, if desired.

FIG. 1 also shows a tensioning device 7 for axially tensioning the printing screen 3. This tensioning device 7 is mounted on one of the end gearing units; in the illustrated embodiment this is end bearing unit 21 which carries a console 70 on which a fluid-operated cylinder-and-piston unit 71 is pivotally mounted at 71*a*. The piston rod of the unit 71 is articulated at 272 to a double-armed lever 72 which has two end portions 72*a* and 72*b* and is thus of fork-like configuration (compare FIG. 7). The lever 72 is pivoted on a pivot 172 secured in the unit 21 and each of the end portions 72*a* and 72*b* is slotted and engages in the respective slot a pin 372 (see FIG. 7) which pins are mounted diametrally opposite one another on the sleeve 121. Unlike the sleeve 120 at the left-hand side of FIG. 1, the sleeve 121 is axially shiftable. The gear 37 and the gear 263 are so constructed in their relative transmission ratio, that the necessary tensioning movement of the screen 3 can be obtained without any difficulty by operation of the cylinder-and-piston unit 71.

Figure 2:
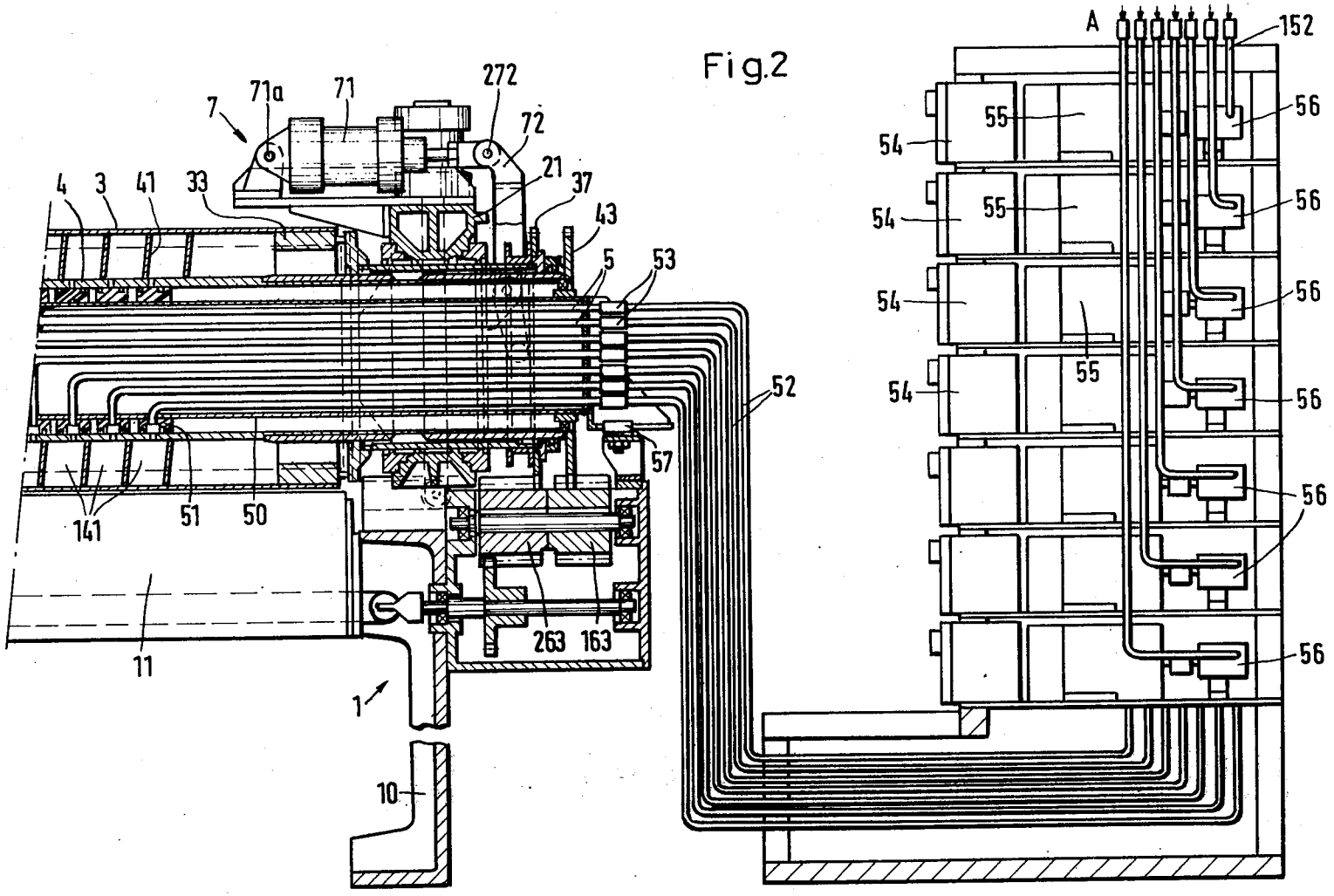
FIG. 2 is a fragmentary vertical section similar to FIG. 1, but illustrating the supply for the printing medium.

FIG. 2 shows that the axially outer ends of the printing-medium tubes 5 (only those at the right-hand end of the machines are shown in FIG. 2) communicate with flexible supply conduits 52 — e.g. hoses or the like — with whih they are connected by means of quick-release couplings 53 which are known per se and are sold for example under the trademark "Nito" by Schlafer GmbH Bad liebanzoll BRD. The purpose of making the conduits 52 flexible is to permit them to move to-and-fro when the entire unit composed of the end bearing units 20, 21, the screen 3 and the traverse members 22, reciprocates from left to right and vice versa.

The conduits 52 extend to a printing-medium supply unit which comprises for each of the conduits 52 a flow regulator 54 of known construction with a C.C. motor driving the pump, the C.C. Motor being sold for ex. by Reliance, Rochester N.Y., U.S.A. with a respective DC motor that drives in turn a respective pump 56 for printing medium. The suction intakes 152 of the pumps 56 communicate with printing-medium supply containers (not illustrated) from which they draw the printing medium in the direction of the arrows A.

Thus, each of the medium chambers 141 defined betweem two axially consecutive ones of the partitions 41 receives from an associated pump 56 a precisely predetermined — and adjustable — quantity of printing ink, printing paste or other printing medium. Additional control devices acting upon the flow regulators 54, may also be provided and are known. Of course, the inner tube 50 does not rotate, although it reciprocates with the arrangement as described before. To prevent the inner tube 50 from rotating it is formed at one of its axial ends, i.e. in the illustrated embodiment at the right-hand axial end, with an extension or projection 150 that is formed with an axial slot into which there extends an anti-rotation member 57 that is mounted on a part of the machine frame 1.

Figure 3:
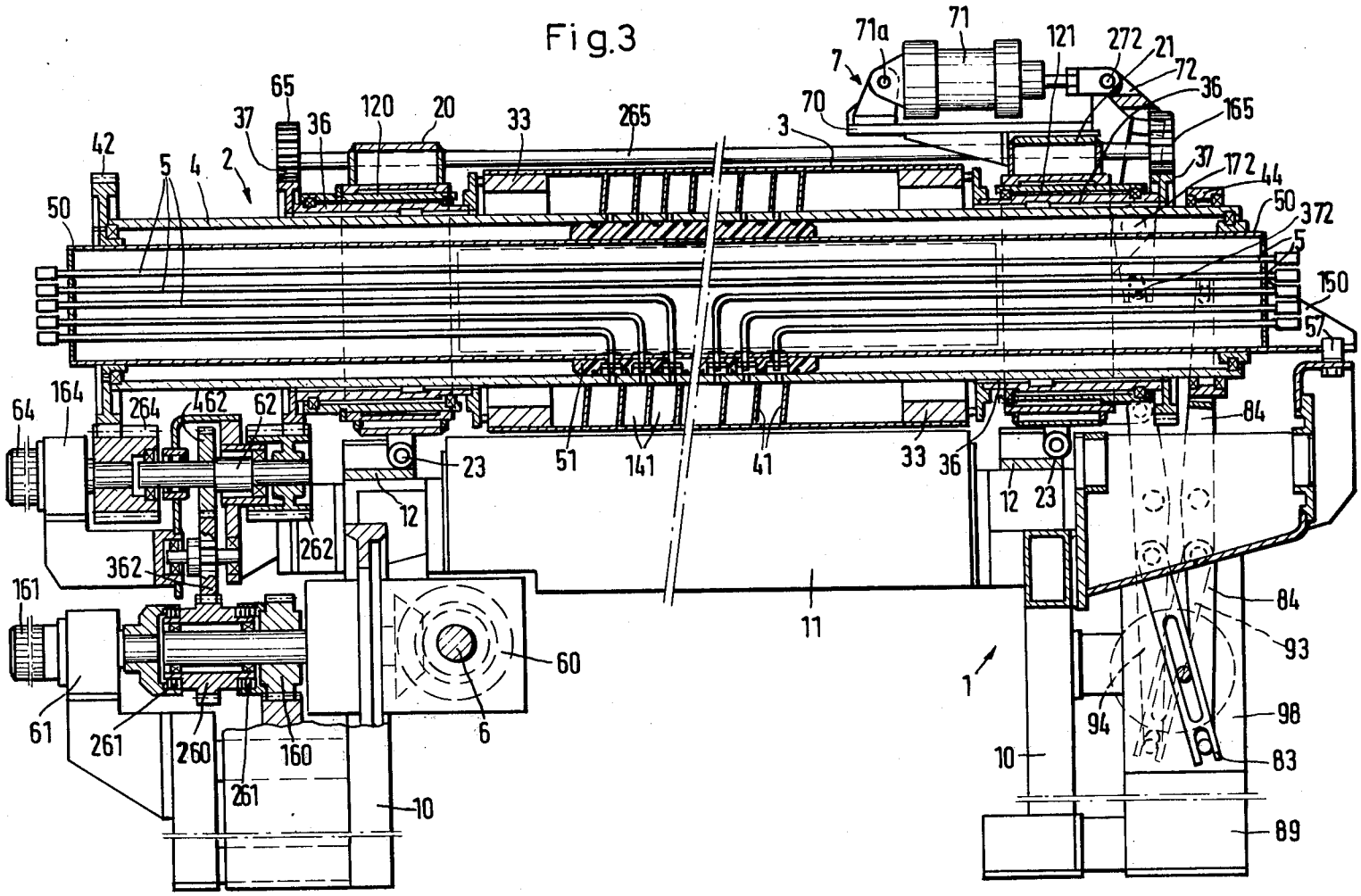
FIG. 3 is a view similar to FIG. 1 but of a further embodiment of the invention.

The embodiment in FIG. 3, which in other ways corresponds to the one in FIG. 1, is provided with a separate drive for the carrier 4. This separate drive comprises a motor 64 which drives a variable gear drive 164, such as a differential gear for example as sold by "PIV" W. Reimers K.G. Bad Homburg BRD, which in turn rotates a gear 264 that meshes with the gear 42. The opposite axial end of the carrier 4 is rotatably journalled within the sleeve 36. In this embodiment, as in the preceding one, the printing screen 3 is again driven from the main drive shaft 6 via the angle drive 60 and the gears 160 and 260. The gear 260 drives via gears 362 and 462 the gear 262 which in turn meshes with the drive gear 37 for the printing screen 3. Torque is transmitted to the right-hand end of the printing screen 3, i.e. the end remote from the end at which the main drive is located which is supplied via the main drive shaft 6, by means of gears 65 and 165 whih mesh with the gears 37 at the opposite axial ends of the printing screen 3 and which are coupled for joint rotation by a shaft 265. Thus, when the gear 65 is rotated by its associated gears 37, it turns the shaft 265 which in turn rotates the gear 165 that transmits rotation to the right-hand end gear 37 and thus supplies torque to the right-hand end of the printing screen 3.

Due to the presence of the two motors 64 and 161 the rotational speeds for the carrier 4 and the printing screen 3 can be freely selected at will, each independently of the other. by means of a transfer clutch 261 as sold for example by Stromag GmbH, Uhna, BRD the drive of the printing screen 3 can selectively be made proportional to the speed of movement of the workpiece web (not shown) or by means of the transmission 61 it can be made independent of any other factor.

Figure 4:
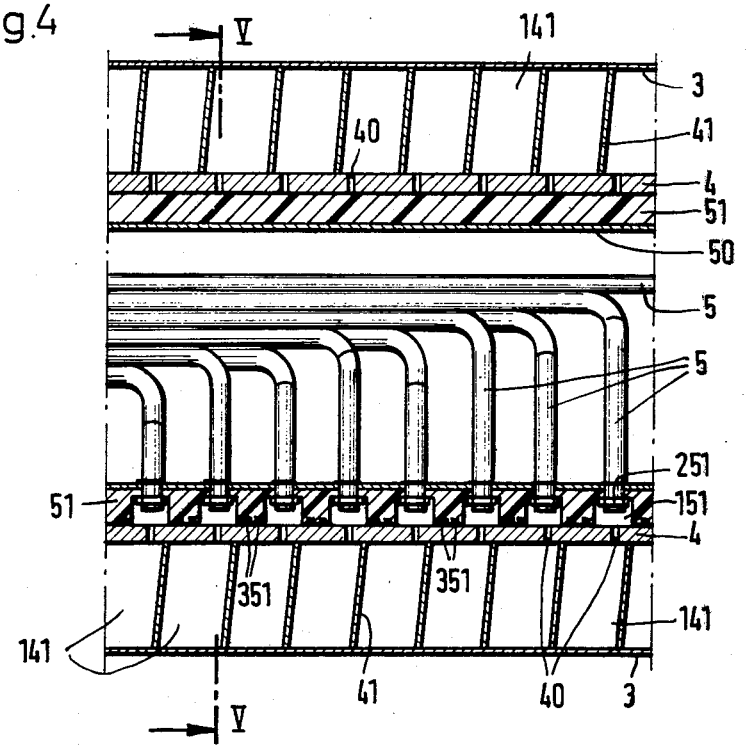
FIG. 4 is a fragmentary vertical section through a printing screen and associated components of the machine accordin to the present invention.
Figure 5:
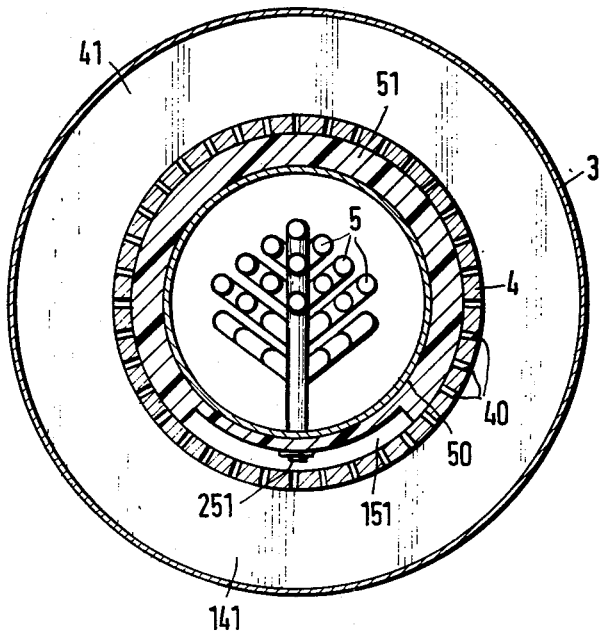
FIG. 5 is a section taken on line V—V of FIG. 4.

FIGS. 4, 5 and 6, which have already been mentioned earlier, illustrate cne example of the supply of printing medium. As shown in these three Figures in more detail, the inner free ends of the tubes 5 extend through openings in the wall of the inner tube 50 into chambers 151 formed in the circumferential wall of the (preferably synthetic plastic) spacing sleeve 51 where they are secured by means of nuts 251. The chambers 151 are separated from one another in axial direction by means of sealing rings or strips 351 — rings or strips may be used as desired — and these chambers 151 discharge the printing medium through openings 40 in the circumferential wall of the carrier 4 into the chambers 141 defined between the successive partitions 41.

The axial reciprocation is effected in all embodiments in the manner shown in FIG. 7, namely by means of two crank drives 8 and 9. The crank drive 9 effects axial reciprocation of the printing screen 3 so that the latter performs an oscillating movement. For this purpose it reciprocates the complete unit composed of the end bearing units 20, 21 which are rigidly connected by the traverse members 22 and which unit moves on the wheels or the like 23 that travel on the rail sections 12. Depending upon the particular stroke being performed by the crank drive 9, this entire unit or carriages moves to the left and to the right, alternately. As illustrated, the crank drive 9 has a motor 90, a continuously variable gear drive 91 which is driven by the motor 90 and which in turn rotates an eccentric disc 92 the eccentricity of which is variable by moving an eccenter pin 92*a* in a radial elongated hole in disc 92 and clamping the pin in the desired position and to vary the stroke, and two swing arms 93 and 94. The swing arm 94 is pivoted to the plate 221 of the end bearing unit 21 via a bolt 95. Opposite the crank drive 9 for the screen 3 there is located a crank drive 8 for effecting a similar reciprocation of the carrier 4. The crank drive 8 also has a motor 80, a continuously variable gear drive 81 which is driven by the motor 80 and in turn drives an eccentric disc 82 the eccentricity of which can be varied, the adjusting being done by moving the exenter pins 82*a* and 92*a* in the radial elongated holes of the discs 82 and 92 and clamping the pins in the desired position, and two swing arms 83 and 84 which are connected with one another. The upper end of the swing arm 84 is bifurcated and forms the arms 184*a* and 184*b*. These arms are connected via bolts or pins 85 with a ring 44

(compare FIG. 1) which surrounds the carrier 4, antifriction bearings (not shown) being interposed between the carrier 4 and the ring 44. Both of the crank drives 8 and 9 are mounted on upright support 98 which in turn is secured centrally on a plate 89. Both crank drives can be adjusted as to the frequency and length of their strokes, and these adjustments can be carried out independently of the respective other crank drive so that an individually adjustable (both as to length and frequency of strokes) reciprocation can be obtained for the screen 3 as well as for the carrier 4.

This means that if desired the screen 3 may be reciprocated alone, the carrier 4 may be reciprocated alone, or both the screen and the carrier may be reciprocated jointly. Also, they may be reciprocated in one and the same direction, in mutually opposite directions, or at different frequencies and different stroke lengths so as to overlap in their reciprocation. The adjustment in the length of stoke and of frequency of stroke can be carried out from zero to the maximum for each of the crank drives 8 and 9 individually by adjusting the eccentric radius of the eccentric discs 82 and 92, respectively. It is evident, of course, that if it is only desired to be able to reciprocate the screen 3, the crank drive 8 can be omitted.

To be able to effect reciprocation of the screen 3 without undue friction between the screen 3 and the workpiece, and to avoid smearing and other disadvantageous consequences, the units 20 and 31 may be tiltably mounted. This is shown for the unit 21 in FIG. 7, where the unit 21 will be seen to have a lug L at which it is secured to its base plate 221 for pivoting about a substantially horizontal pivot 321 at one lateral side of the printing screen 3. At the opposite lateral side there is provided a screw-spindle unit 427 screwable in a lug secured to the unit 27 and reacting against the plate 221, thus being able to lift the unit 21 and the screen 3 upwardly of the plane of movement — and hence the upper surface of — the workpiece to a desired degree. The unit 20 is of course similarly mounted and provided.

FIG. 8 shows a further embodiment of the invention which illustrates that the invention can also be employed in a screen printing machine of the type having an endless belt-type screen 3*a* which is trained about three screen supporting rollers 30, 31 and 32 arranged at the corners of an imaginary triangle. In this embodiment it will be the opposite axial ends of the rollers 30, 31 and 32 which are journalled in the end bearing units 20' and 21' which are again connected by traverse members 22' to form a rigid unit and which are again movable on the rail sections 12 by means of the wheels or the like 23. The counter pressure beam 11 is present as before, and a printing blanket 14 travels above the counter pressure beam 11 and beneath the lower printing run of the screen 3*a*, the workpiece 13 travelling in the direction of the arrow intermediate the advancing printing blanket 14 (which also travels in the direction of the workpiece) and the printing screen 3*a*. A roller squeegee 38 of known construction may be employed which is located within the confines of the screen 3*a* and squeezes printing medium through the same.

In FIG. 8 only the end bearing unit 20' is diagrammatically illustrated; the unit 21' is not visible. The units 20' and 21' may be again mounted for pivoting about horizontal pivots 321, by means of the spindles 421 as described with reference to FIG. 7. In this embodiment the axially spaced partitions 41*a* (only one shown) are simply planar partition walls which do not rotate as in the preceding embodiments but which are so shaped as to conform to the inner surface of the printing screen 3*a* at the lower printing run thereof — i.e. where it is juxtaposed with the workpiece 13 — and to the outer circumferential surfaces of the rollers 30, 31 and of the carrier 4. The entire unit can be axially reciprocated, but the carrier 4 does not rotate.

Figure 9:
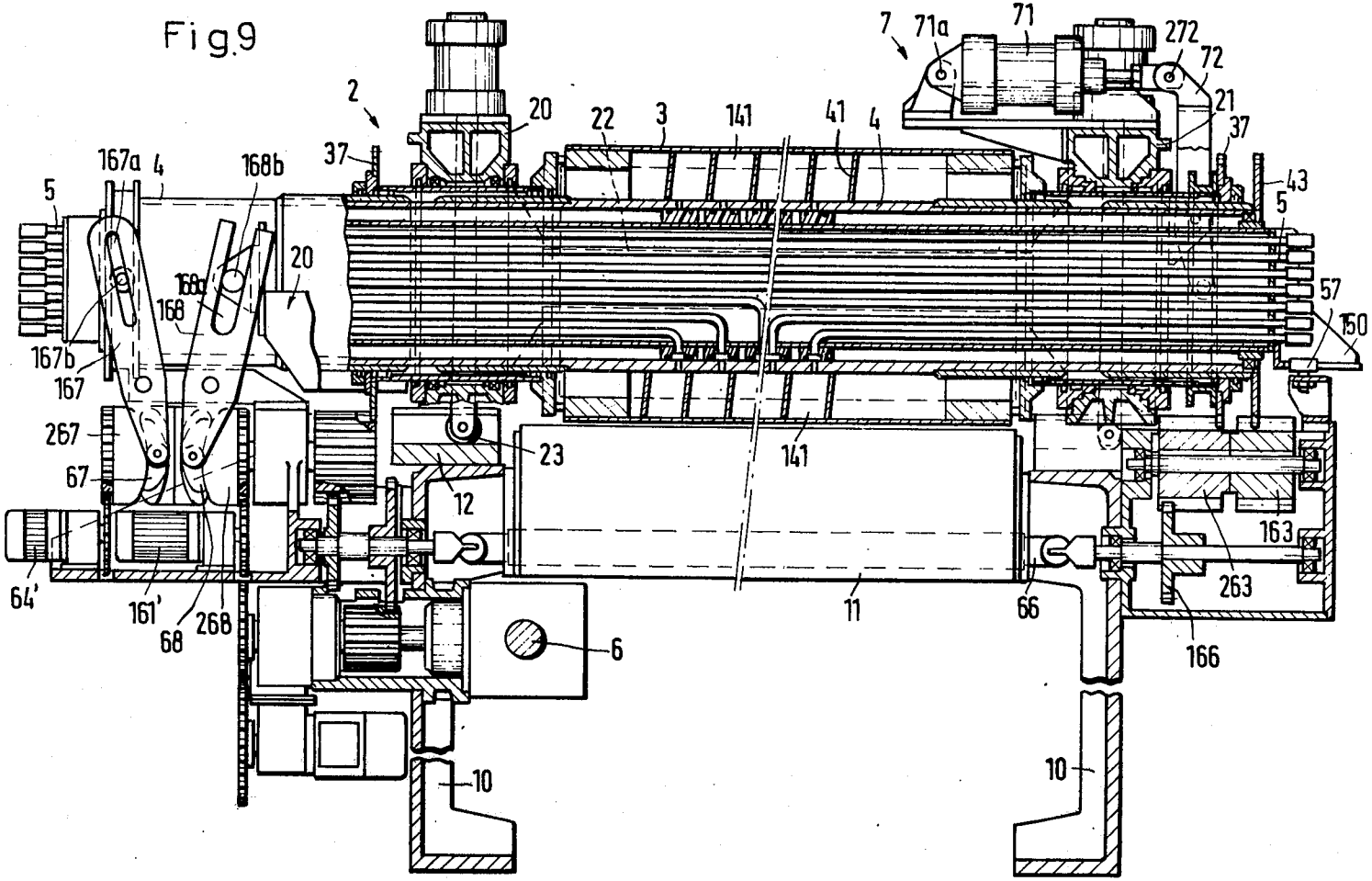
FIG. 9 is a view similar to FIG. 1 but illustrating still a further embodiment of the invention.
Figure 10:
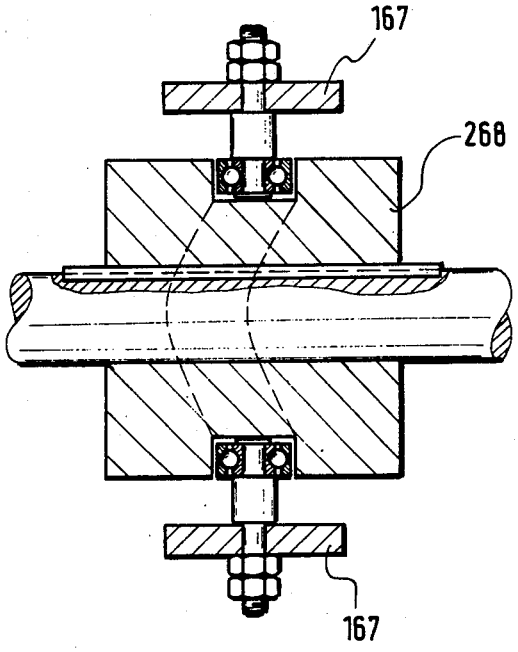
FIG. 10 is a drum similar to FIG. 9.

Still a further embodiment of the invention is illustrated in FIG. 9 which generally resembles the embodiment in FIG. 1 and wherein like elements again are identified by identify like reference numerals. In the embodiment of FIG. 9 the crank drives 8 and 9 are replaced with other units as will be described, and a coupling shaft 66 is provided which replaces the shaft 265 shown in FIG. 3. The shaft 66 is located within the machine frame, instead of outside of it as is the shaft 265.

The crank drives 8 and 9 have been replaced in FIG. 9 by cam curves 67 and 68 which are engaged by roller followers provided on respective arms 167 and 168. The arm 167 has an axial slot 167a into which a pin 167*b* engages that is secured on the axially reciprocable carrier 4. Arm 168 is also provided with an axial slot 168*a* into which a pin 168*b* slidably extends which is provided on the end bearing unit 20. The units 20 and 21 are of course again connected by the traverse members 22 to form an axially reciprocable unit with one another and with the screen 3. The length of the axial strokes can be adjusted within a certain range in the embodiment of FIG. 9, whereas the frequency of reciprocation is predetermined by the shape of the cam curves or cam tracks 67, 68 and can be varied by replacing these tracks with other differently shaped ones. For this purpose the two drums 267, 268 on which the cam curves 67 and 68 are provided, can be replaced with drums having other curves. The drums 267, 268 are driven independently of one another at individually variable speed of rotation, by means of drive motors 64' and 161' via respectively associated variable gear drives.

Arm 167 effects axial reciprocation of the carrier 4 and arm 168 effects axial reciprocation of the unit which includes the printing screen 3. Torque is transmitted from the shaft 6 via the illustrated gearing to the left-hand end of the station, and is also transmitted to the right-hand end of the station via the illustrated shaft 66. Screen 3 and carrier 4 are driven via gears 166, 263 and 163.

It will be appreciated that the invention is susceptible of many modifications without departing in any way from the intent and scope of the invention. What is important is the possibility of axially reciprocating the screen 3 during the printing operation, and the fact that there is in effect produced a "carriage" by rigidly connecting the end bearing units 20 and 21 with one another via the traverse members 22 so that the unit can be reciprocated in toto. Other ways of effecting the reciprocation can be employed, for example cams can be used, or other devices. The possibility of pivoting the units 20, 21 about the pivots 321, and hence raising the screen 3 with reference to the working plane, is important. This makes it possible to adjust the contact — and pressure — between the screen and the workpiece very precisely and to so select it that during the reciprocation of the screen no smearing of the printed pattern on the workpiece will develop.

It will be understood that each of the elements described above, or two or more together, may also find a useful application in other types of constructions differing from the types described above.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A screen printing machine, comprising an endless printing screen of generally annular configuration; end bearing units located at the respective ends of the annulus formed by said endless printing screen and mounting the latter for advancement in an endless path; connecting means connecting said end bearing units with one another to form a carriage unit on which said screen is mounted; means for advancing a workpiece web to be printed in a working path beneath the annulus formed by said screen and in a direction transverse to the longitudinal axis of said annulus; and reciprocating means for reciprocating said carriage unit and said screen in direction transverse of said working path during the advancement of said web in said working path whereby the patterning on the workpiece web is varied.

2. A screen printing machine as defined in claim 1; said connecting means comprising traverse members connecting said end bearing units.

3. A screen printing machine as defined in claim 2; further comprising a frame; and means supporting said carriage unit reciprocably on said frame.

4. A screen printing machine as defined in claim 3, wherein said supporting means comprises rails on said frame, and rolling means on said carriage unit and engaging said rails.

5. A screen printing machine as defined in claim 1; said advancing means comprising workpiece web supporting means below said screen and having a surface adapted to support the web to be printed; and means for adjusting the vertical spacing of said screen from said surface.

6. A screen printing machine as defined in claim 1, each of said end bearing units having a support plate, a casing, means mounting said casing on said support plate tiltable about a substantially horizontal axis, and means for effecting such tilting.

7. A screen printing machine as defined in claim 1, wherein said reciprocating means comprises a crank drive.

8. A screen printing machine as defined in claim 1, wherein said reciprocating means comprises a continuously variable crank drive so as to permit continuous adjustment of the reciprocating movement.

9. A screen printing machine as defined in claim 1; further comprising mounting elements mounting said screen on said end bearing units; and tensioning means for tensioning said screen transversely of said endless path and longitudinally of the annulus formed by said screen.

10. A screen printing machine as defined in claim 9, said mounting elements comprising a pair of end rings on said screen, a pair of mounting rings each axially adjacent one of said end rings, connecting members connecting said end rings to the respectively adjacent mounting ring and mounting sleeves rigidly connected with the respective mounting rings and each journalled in one of said bearing units.

11. A screen printing machine as defined in claim 1, and admitting means for admitting printing medium into the interior of said printing screen.

12. A screen printing machine, comprising an endless printing screen of generally annular configuration; end bearing units located at the respective ends of the annulus formed by said endless printing screen and mounting the latter for advancement in an endless path; admitting means for admitting printing medium into the interior of said generally annular endless printing screen, for subsequent passage of the printing medium through the printing screen and printing on a web beneath said screen; reciprocating means for reciprocating at least one of said screen and admitting means in direction axially of the annulus formed by said endless printing screen; mounting elements mounting said screen on said bearing units, and comprising a pair of end rings on said screen, a pair of mounting rings each axially adjacent one of said end rings, connecting members connecting said end rings to the respectively adjacent mounting ring, and mounting sleeves rigidly connected with the respective mounting rings; a journalling sleeve in each of said end bearing units end and journalling one of said mounting sleeves for rotation, one of said journalling sleeves being slidable in axial direction of said annulus; and tensioning means for tensioning said screen transversely of said endless path and longitudinally of the annulus formed by said screen.

13. A screen printing machine as defined in claim 12; further comprising means for advancing said screen in an endless path, comprising a drive having a drive gear, a pair of screen-drive gears fixedly mounted on said screen at opposite ends of said annulus, and driven gears driven by said drive gear and each meshing with one of said screen drive gears, each of said driven gears having an axial length greater than the axial length of the respectively meshing screen drive gear so as to remain in mesh therewith during reciprocation of said screen.

14. A screen printing machine as defined in claim 13; further comprising a shaft journalled for rotation and having spaced end portions, and a shaft gear on each of said end portions, one of said shaft gears and the other of said shaft gears meshing with one of said screen drive gears.

15. A screen printing machine, comprising an endless printing screen of generally annular configuration; end bearing units located at the respective ends of the annulus formed by said endless printing screen and mounting the latter for advancement in an endless path; admitting means for admitting printing medium into the interior of said generally annular endless printing screen, for subsequent passage of the printing medium through the printing screen and printing on a web beneath said screen; and reciprocating means for reciprocating at least one of said screen and admitting means in direction axially of the annulus formed by said endless printing screen, said reciprocating means comprising a rotatable drum having a surface with a cam track, a pivot arm having a follower engaging said cam track so as to pivot in response to rotation of said drum and also having a portion connected with said screen, and means for rotating said drum at continuously variable speed.

* * * * *